United States Patent [19]

Tokumitsu

[11] Patent Number: 4,780,708

[45] Date of Patent: Oct. 25, 1988

[54] DISPLAY CONTROL SYSTEM

[75] Inventor: Shigenori Tokumitsu, Fukaya, Japan

[73] Assignee: Kabushiki Kaisha Toshiba, Kawasaki, Japan

[21] Appl. No.: 805,901

[22] Filed: Dec. 6, 1985

[30] Foreign Application Priority Data

Dec. 7, 1984 [JP] Japan ..... 59-257411

[51] Int. Cl.[4] ..... G09G 1/14

[52] U.S. Cl. ..... 340/720; 340/750; 340/798

[58] Field of Search ..... 340/720, 701, 721, 703, 340/725, 750, 798, 724, 814

[56] References Cited

U.S. PATENT DOCUMENTS 4,459,677 7/1984 Porter et al. ..... 340/750
4,475,161 10/1984 Stock ..... 340/724
4,564,915 1/1982 Evans et al. ..... 340/701
4,580,134 4/1986 Campbell et al. ..... 340/725

FOREIGN PATENT DOCUMENTS 3114923 4/1982 Fed. Rep. of Germany .

*Primary Examiner*—Gerald L. Brigance
*Assistant Examiner*—Mahmoud Fatahiyar
*Attorney, Agent, or Firm*—Cushman, Darby & Cushman

[57] ABSTRACT

A predetermined display period is divided into a plurality of shorter display periods. Image data is stored in an image memory and read in accordance with a period for reading the data from the memory. An accessing period is also provided, and access to the memory is made when the addressing mode is being set in a mode register during the accessing period, whereby the data is displayed by raster scanning.

7 Claims, 7 Drawing Sheets

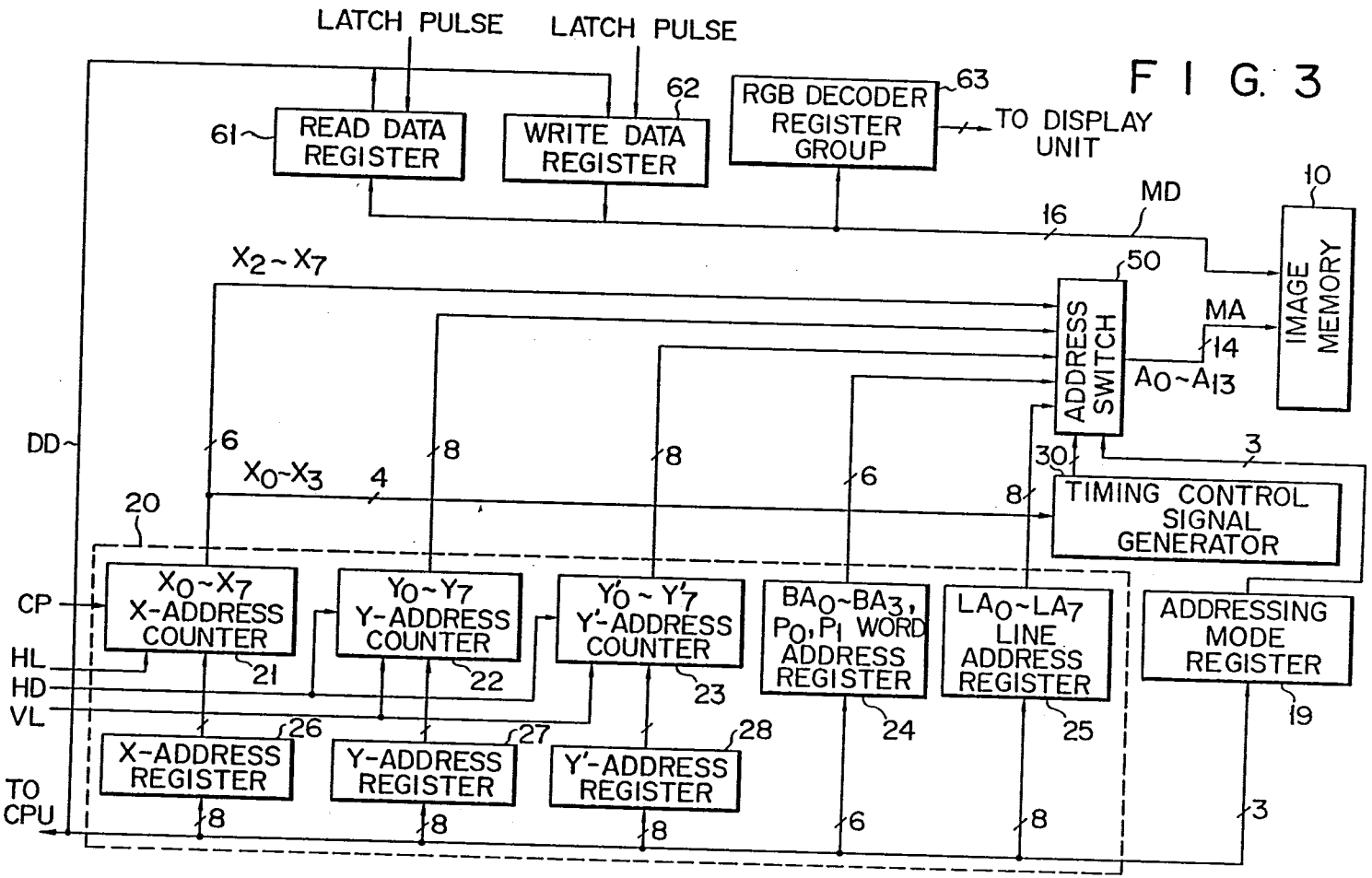
FIG. 3
IMAGE MEMORY
10
MA
14
A0~A13
MD
50
ADDRESS SWITCH
TIMING CONTROL SIGNAL GENERATOR
3
ADDRESSING MODE REGISTER
19
TO DISPLAY UNIT
16
30
8
LA0~LA7 LINE ADDRESS REGISTER
25
63
RGB DECODER REGISTER GROUP
6
BA0~BA3, P0,P1 WORD ADDRESS REGISTER
24
LATCH PULSE
62
WRITE DATA REGISTER
Y'0~Y'7 Y'-ADDRESS COUNTER
23
28
Y'-ADDRESS REGISTER
LATCH PULSE
READ DATA REGISTER
Y0~Y7 Y-ADDRESS COUNTER
22
27
Y-ADDRESS REGISTER
61
X2~X7
X0~X3
4
X0~X7 X-ADDRESS COUNTER
21
26
X-ADDRESS REGISTER
20
DD
CP
HL
HD
VL
TO CPU

| PERIOD \ ADDRESS | $A_0$ | $A_1$ | $A_2$ | $A_3$ | $A_4$ | $A_5$ | $A_6$ | $A_7$ | $A_8$ | $A_9$ | $A_{10}$ | $A_{11}$ | $A_{12}$ | $A_{13}$ |
|---|---|---|---|---|---|---|---|---|---|---|---|---|---|---|
| DP Adr | $X_4$ | $X_5$ | $X_6$ | $X_7$ | $Y_0$ | $Y_1$ | $Y_2$ | $Y_3$ | $Y_4$ | $Y_5$ | $Y_6$ | $Y_7$ | 0 | 0 |
| FG Adr | | | | | | | | | | | | | | |
| BG Adr | $X_4$ | $X_5$ | $X_6$ | $X_7$ | $Y_2$ | $Y_3$ | $Y_4$ | $Y_5$ | $Y_6$ | $Y_7$ | $X_2$ | $X_3$ | 1 | 0 |
| CC Adr | | | | | | | | | | | | | | |
| WRITE | $BA_0$ | $BA_1$ | $BA_2$ | $BA_3$ | $LA_0$ | $LA_1$ | $LA_2$ | $LA_3$ | $LA_4$ | $LA_5$ | $LA_6$ | $LA_7$ | $P_0$ | $P_1$ |

| ADDRESS / PERIOD | $A_0$ | $A_1$ | $A_2$ | $A_3$ | $A_4$ | $A_5$ | $A_6$ | $A_7$ | $A_8$ | $A_9$ | $A_{10}$ | $A_{11}$ | $A_{12}$ | $A_{13}$ |
|---|---|---|---|---|---|---|---|---|---|---|---|---|---|---|
| DP Adr | $X_4$ | $X_5$ | $X_6$ | $X_7$ | $Y_0$ | $Y_1$ | $Y_2$ | $Y_3$ | $Y_4$ | $Y_5$ | $Y_6$ | $Y_7$ | 0 | 0 |
| FG Adr | | | | | | | | | | | | | | |
| BG Adr | $X_4$ | $X_5$ | $X_6$ | $X_7$ | $Y_2$ | $Y_3$ | $Y_4$ | $Y_5$ | $Y_6$ | $Y_7$ | $X_2$ | $X_3$ | 1 | 0 |
| CC Adr | | | | | | | | | | | | | | |
| DP' Adr | $X_4$ | $X_5$ | $X_6$ | $X_7$ | $Y'_0$ | $Y'_1$ | $Y'_2$ | $Y'_3$ | $Y'_4$ | $Y'_5$ | $Y'_6$ | $Y'_7$ | 0 | 1 |
| FG' Adr | | | | | | | | | | | | | | |
| BG' Adr | $X_4$ | $X_5$ | $X_6$ | $X_7$ | $Y'_2$ | $Y'_3$ | $Y'_4$ | $Y'_5$ | $Y'_6$ | $Y'_7$ | $X_2$ | $X_3$ | 1 | 1 |
| CC' Adr | | | | | | | | | | | | | | |

| ADDRESS / PERIOD | $A_0$ | $A_1$ | $A_2$ | $A_3$ | $A_4$ | $A_5$ | $A_6$ | $A_7$ | $A_8$ | $A_9$ | $A_{10}$ | $A_{11}$ | $A_{12}$ | $A_{13}$ |
|---|---|---|---|---|---|---|---|---|---|---|---|---|---|---|
| DP1 Adr | | | | | | | | | | | | | | |
| DP2 Adr | | | | | | | | | | | | | | |
| DP3 Adr | $X_4$ | $X_5$ | $X_6$ | $X_7$ | $Y_0$ | $Y_1$ | $Y_2$ | $Y_3$ | $Y_4$ | $Y_5$ | $Y_6$ | $Y_7$ | $X_2$ | $X_3$ |
| DP4 Adr | | | | | | | | | | | | | | |
| WRITE | $BA_0$ | $BA_1$ | $BA_2$ | $BA_3$ | $LA_0$ | $LA_1$ | $LA_2$ | $LA_3$ | $LA_4$ | $LA_5$ | $LA_6$ | $LA_7$ | $P_0$ | $P_1$ |

DISPLAY CONTROL SYSTEM

BACKGROUND OF THE INVENTION

The present invention relates to a display control system for controlling color graphic data to be displayed by a raster scanning, color graphic display unit.

Generally, no image signals are transmitted during the horizontal scanning period, i.e., part of the vertical blanking period of a television signal. However, teletext systems allow character data and figure data (i.e., digital signals) to be transmitted to a receiver terminal during the horizontal scanning period. These pieces of data are temporarily stored in the image memory provided in the receiver terminal. They are read from the memory and supplied to the raster scanning, color graphic display unit of the receiver terminal.

Various standard image display formats have been proposed for this teletext system. Among them is a format consisting of 248 (horizontal)×204 (vertical) picture elements. To shorten the time for transmitting the image data of this format and to reduce the price of the terminal, the unit of data to be controlled for coloring and flashing consists of four picture elements, i.e., 4 (horizontal)×4 (vertical) elements, and does not represent an individual picture element. This unit will be hereinafter called a "functional block."

To control the brightnesses of the 16 picture elements of each functional block, i.e., 4×4 dot pattern DP, a 16-bit luminance data signal is required. Further, 4-bit FG (foreground) color data, 4-bit BG (background) color and 4-bit data attribute CC data are allotted to each functional block. The FG color data and the BG color data each consist of 1-bit red data R, 1-bit green data G, 1-bit blue data B and 1-bit intensity-lowering data RI.

To display the image data stored in the image memory, each 4-bit dot pattern DP is scanned in the horizontal direction, thus reading 4 bits from the image memory. For the same purpose, the 4-bit FG/BG color data and 4-bit data attribute CC allotted to pattern DP (i.e., the functional block) are then read from the image memory. The image data thus read out of the memory is displayed by the raster scanning, color graphic display unit.

In most teletext system of this type, image data is processed in units of eight bits and is written in and read from the memory through an 8-bit data bus. Hence, four 8-bit pieces of data, i.e., an 8-bit dot pattern DP, an 8-bit FG color data, an 8-bit BG color data and an 8-bit attribute data CC must be read from the image memory during the period of displaying eight picture elements (8 bits) in the horizontal direction.

The image memory used in most teletext systems is a dynamic random access memory (DRAM). A DRAM has a large capacity, and its cost per bit is low. However, its cycle time is 200 to 260 nsec, and its accessing time is relatively long. Thus, when clock pulses of 5.73 MHz (the pulse interval: approx. 175 nsec), i.e., a frequency 8/5 times that (3.58 MHz) of the color sub carrier, are used to read the image data from the DRAM and then to convert it to serial data, one-clock period of 175 nsec is too short; therefore, 2 clock, periods, i.e., 350 nsec, are necesary. Therefore, in a conventional display control system, the four pieces of 8-bit data are serially converted to serial data and are read from an image memory in an 8-clock period. In this case, all of the 8-bit clock period is used for only the reading of data as shown in FIG. 1. The conventional display control system is, therefore, disadvantageous in that no data can be written into the image memory during the displaying period, inevitably reducing the data-writing efficiency.

This disadvantage can be eliminated by using a static RAM having a short accessing time. Data can be written into the static RAM even during the displaying period by using the cycle steal technique. However, the static RAM is expensive, and it is difficult to design hardware for a high-speed, accurately timed operation.

Also, four pieces of data can be written into the image memory during the displaying period if the address area of the memory is divided into four parallel sub-areas as showing FIG. 2. This method, however, leaves a large part of the memory vacant, and the resultant image memory is larger than necessary.

In some teletext systems, each receiver terminal has two image memories for storing two frame-images and two display control devices for controlling the image memory and reading the two frame-images independently from the memory so that a hybrid display is achieved by combining the two images. Obviously, the receiver terminal is inevitably larger and more expensive than the receiver terminal with only one such display control device.

SUMMARY OF THE INVENTION

An object of the present invention is to provide a display control system which can perform addressing of an image memory when an addressing mode is set to the image memory so as to efficiently make access to the different types of image data stored in one address area of the memory and to control the addresses of pieces of frame-images.

According to the present invention, there is provided a display control system which allows for the reading of a large quantity of image data in a short time, e.g. the data displaying period, from a memory having a relatively short access time, without decreasing the data-writing efficiency. The system can perform an efficient addressing of the memory when an addressing mode is set to it, so that pieces of the image data can be efficiently stored in the memory area of the image memory and can be displayed in various modes including a hybrid display, without increasing the size of the circuit incorporated in the system.

BRIEF DESCRIPTION OF THE DRAWINGS

FIG. 3 is a block diagram of an embodiment of the present invention;

DETAILED DESCRIPTION OF THE PREFERRED EMBODIMENTS

An embodiment of the present invention will be described in detail with reference to a display control system applied to the receiver terminal of a teletext system.

In FIG. 3, 16-bit data bus MD is connected to an image memory 10. Four pieces of 16-bit data are read from memory 10 during a 16-clock cycle of a clock signal CP. The pieces of data are dot pattern data DP, FG (foreground color) data, BG (background color) data and data attribute CC. They are read from memory 10 during 2-clock periods as in the above-mentioned conventional display control system using an 8-bit data bus.

Figure 1:
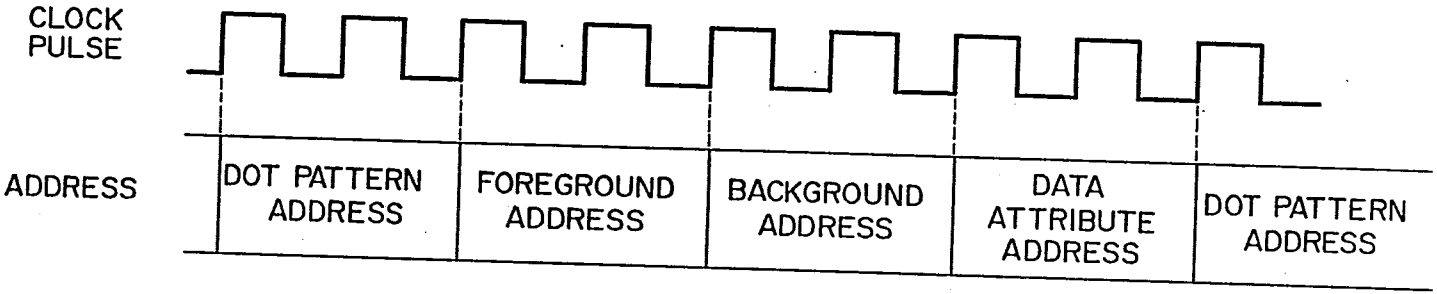
FIG. 1 is a timing chart showing the clocks and the addressing of a conventional image display unit.
Figure 2:
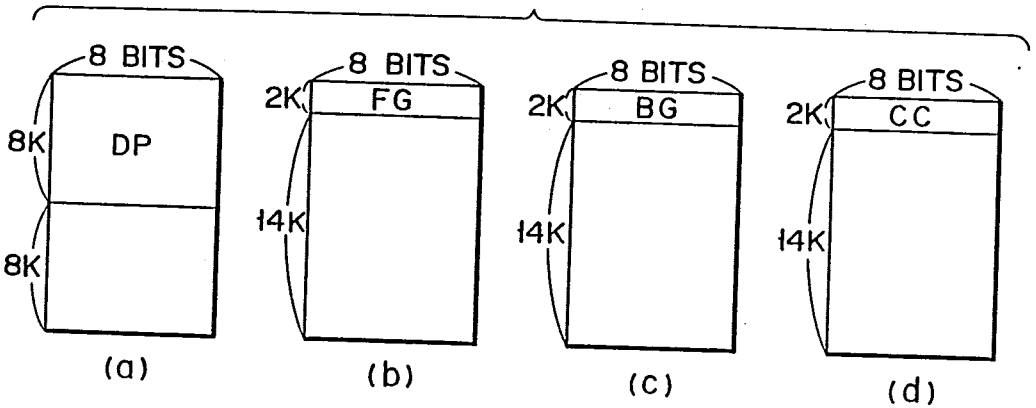
FIG. 2 shows an example of an inefficient addressing map.
Figure 4:
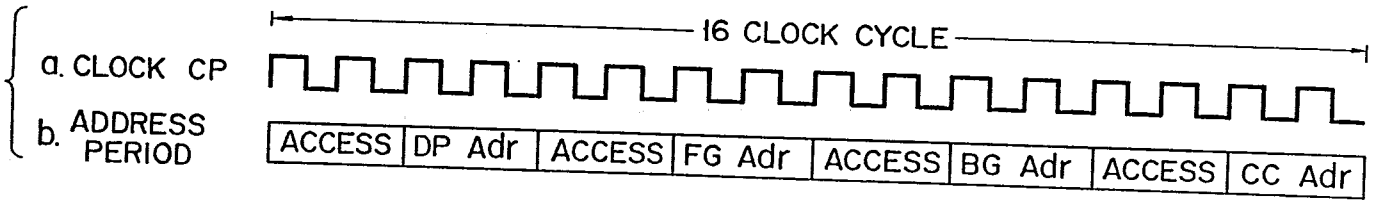
FIG. 4 is a timing chart showing the relationship between the clocks and the addressing of the embodiment shown in FIG. 3.

Since data bus MD connected to image memory 10 is of 16-bit configuration, as shown in FIG. 4, four discrete accessing periods can be provided besides the reading period of the display data as shown in FIG. 4. As illustrated in FIG. 3, a central processing unit (CPU) can gain access to memory 10 through a read data register 61 or a write data register 62 during the accessing period.

Further, any of the four accessing periods are selected in accordance with the addressing mode set in an addressing mode register 19. The CPU can therefore access memory 10 in various ways.

The teletext system, in which the display control system is used, has a display format of 248 (horizontal×204 (vertical) picture elements. Thus, each horizontal image display area and each vertical image display area of the screen of the display unit used in the receiving terminal can be specified by an 8-bit X-address and an 8-bit Y-address.

Data bud MD is a 16-bit bus. Hence, the image data to be displayed is read from memory 10 in units of 16 bits. Each horizontal display area in which 16-bit image data can be displayed can take 16 different positions on every horizontal line of the screen. Four bits are sufficient to represent any of these positions. In this embodiment, the more significant four bits of the X-address are used to designate the position and are supplied as a horizontal address to image memory 10. FG color data, BG color data and data attribute CC for each 4×4 dots pattern DP consist of four bits each. Therefore, the data representing the position of each of these 4-bit data on any vertical line of the screen must be formed of six bits. The most significant six bits of the Y-address are used for this purpose.

An embodiment of the present invention will now be described in more detail with reference to the block diagram of FIG. 3.

Image memory 10 stores four pieces of image data, i.e., a dot pattern DP, FG color data, BG color data and data attribute CC. These pieces of data are stored in one address area, in the form of 16 parallel bits. The address for accessing memory 10 is generated by address generator 20. More specifically, X-address counter 21, Y-address counter 22, and Y'-address counter 23 generate an address for reading the data to be displayed by a raster scanning, color graphic display unit. Word address register 24 and line address register 25 generate an address designating the address of memory 10 to which a controller, such as an 8-bit CPU, has access. X-address register 26, Y-address register 27 and Y'-address register 28 store an address for starting a scroll display.

Counter 21 is an 8-bit counter for counting display clocks CP synchronized with the raster scanning and generates an 8-bit display X-address. The four most significant bits, $X_4$ to $X_7$ of the counter 21 form a horizontal address to be supplied to memory 10, and the four less significant bits, $X_0$ to $X_3$, are used as a reference for generating a timing signal in the 16-clock period. Bits $X_2$ and $X_3$ are used to designate the address of FG color data, BG color data, or data attribute CC.

Counter 22 is an 8-bit counter for counting horizontal drive pulses HD, each generated when one-line horizontal scanning is performed, and it generates an 8-bit display Y-address. As described above, the vertical address of the dot pattern DP consists of all bits $Y_0$ to $Y_7$ of the output of counter 22, and the horizontal address of FG color data, BG color data, or data attribute CC consists of the six more significant bits, $Y_2$ to $Y_7$.

Counter 23 is equivalent to counter 22, and helps the display unit to display two discrete pictures when memory 10 stores the image data representing these pictures.

Register 24 is a 6-bit register. It stores four horizontal address bits ($BA_0$ to $BA_3$) and two bits ($P_0$, $P_1$) for designating the area assigned to a specified type of the image data.

Register 25 is an 8-bit register and stores an 8-bit vertical accessing address ($LA_0$ to $LA_7$).

Registers 24 and 25 are connected to output ports of the CPU and latch the address data $BA_0$ to $BA_3$, $P_0$, $P_1$, $LA_0$ to $LA_7$ output through internal data bus DD in response to a latch pulse output from an address decoder (not shown).

Registers 26, 27 and 28 store display start addresses for loading the counters 21, 22, 23 at the predetermined times so as to display horizontal and vertical scroll displays and to execute the horizontal and vertical scroll displays by varying the display start addresses.

The display start X-address stored in register 26 is loaded in the counter 21 by a load pulse HL of the horizontal period. Similarly the display start Y-and Y'-addresses stored in the registers 27 and 28 are loaded in the counters 22 and 23 by a load pulse VL of the vertical period.

The timing for supplying a plurality of addresses generated from generator 20 to memory 10 is defined by timing control signal generator 30. Generator 30 decodes the four less significant bits, $X_0$ to $X_3$, given from counter 21 and divides the 16-cycle period of the clocks CP into eight periods as shown in FIG. 4.

Figure 5:
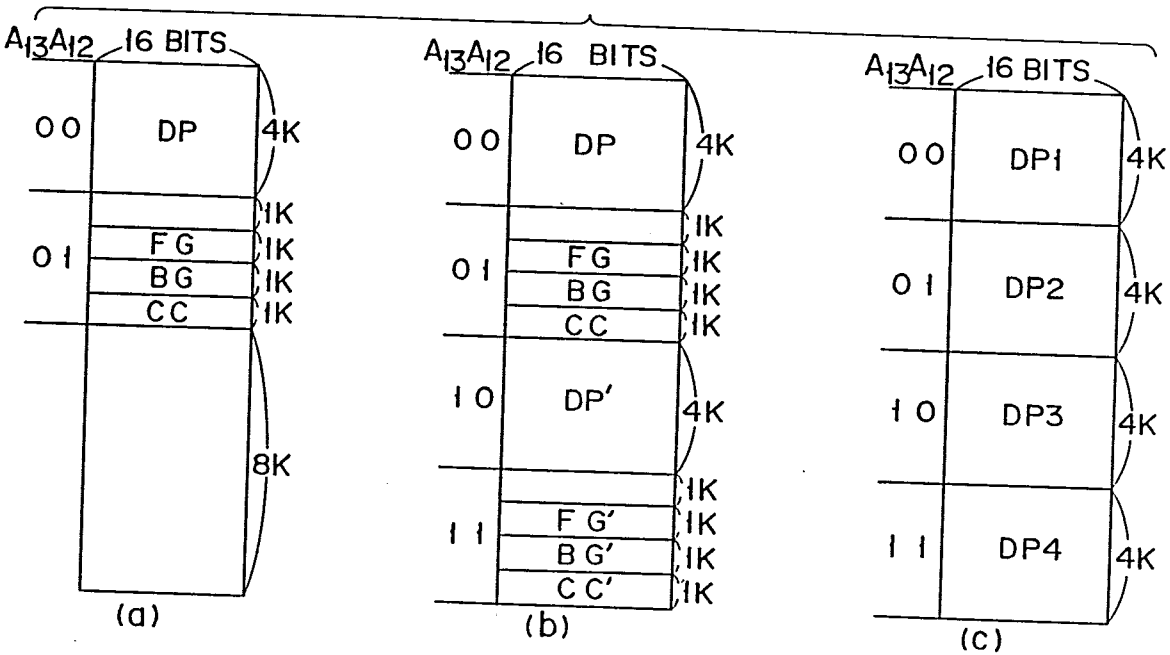
FIG. 5 is a memory map of three modes of the embodiment shown in FIG. 3.

FIG. 5 is a memory map showing the contents of memory 10. Memory 10 stores the image data of one picture in addressing mode I, as shown in FIG. 5(*a*), and the image data of two pictures in addressing mode II (hybrid display), as shown in FIG. 5(*b*). Further, memory 10 stores the image data (not a 4×4 bit functional block) representing picture elements to be colored, in addressing mode III, as shown in FIG. 5(*c*). Different addresses are used to address memory 10 for these three pieces of data, and this addressing is controlled by the three modes stored in addressing mode register 19. With this mode selection, one skilled in the art will realize the possible display options. For example, the present invention may allow two pictures to be displayed on the display units in a hybrid manner.

The addresses generated from generator 20 are supplied to memory 10 through address switch 50 and bus MA in response to the addressing mode set in register 19 and the access timing signal generated during the 16-clock period by a timing control signal generator 30. Thus, the image data stored at the address is read from memory 10.

The CPU reads the image from memory 10 through 16-bit bus MD, read data register 61 and 8-bit bus DD. It supplies the data to memory 10 through 8-bit bus DD, write data register 62 and 16-bit bus MD. To display the image data, the CPU reads the data from memory 10 and writes the data in RGB decoder register group 63, converts the data into RGB signals, and supplies these signals to the display unit.

Figure 6:
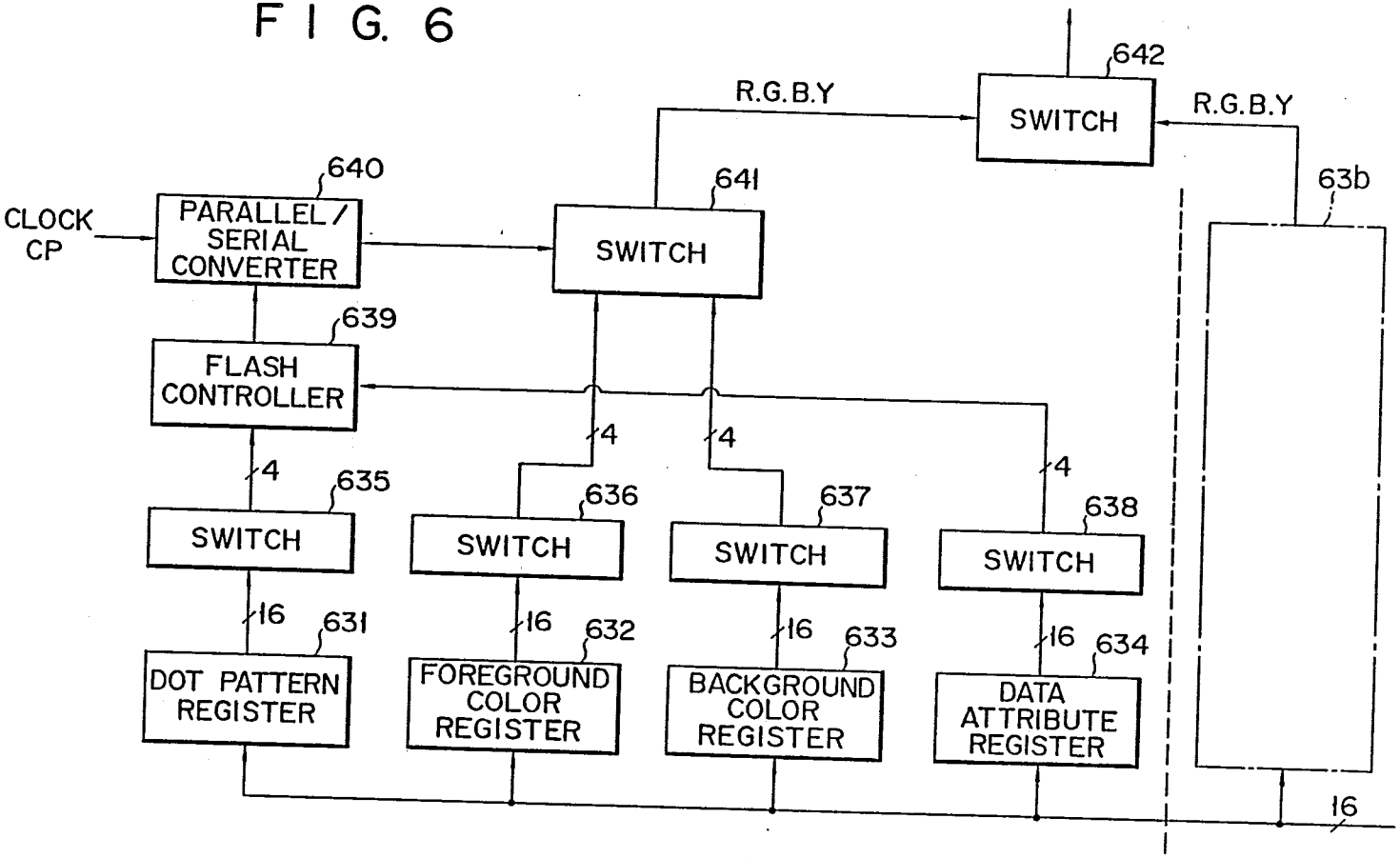
FIG. 6 is a block diagram of RGB register groups of the embodiment shown in FIG. 3.

FIG. 6 is a block diagram showing an example of RGB decoder register group 63. The register group 63 comprises two identical circuits, one of which will be explained in detail.

The image data read out from memory 10 in time division fashion is stored in dot pattern register 631, foreground color register 632, background color register 633 and a data attribute register 634. The pieces of 16-bit image data output from registers 631 and 634 in 16-bit width are supplied to switches 635 to 638. Each of these switches selects four bits of the input data. (These four bits form a minimal unit of data, i.e. a functional block). The outputs of switch 635, i.e. the dot pattern signal, are supplied through flashing controller 639 to parallel/serial converter 640. Controller 639 performs flashing control in accordance with data attribute supplied from switch 638. More specifically, it forces the dot pattern signal DP to a low level. Converter 640 converts the outputs of switch 635 into a serial signal in synchronization with the clock pulse. The serial dot pattern signal is applied to switch 641. The outputs of switches 636, 637 are also applied to switch 641. Switch 641 selects FG color data or BG color data. FG color data is selected when the dot pattern signal DP is at low level, and BG color data is selected when the signal DP is at low level.

The RGB outputs of switch 641 are combined by switch 642 with the RGB output of RGB register group 63B. The combinations of these outputs are displayed on the raster scanning, color display unit (not shown) in the predetermined order.

The operations in the above-described three display modes will be described.

In mode I, the image data of one screen is stored in memory 10 as shown in FIG. 5(*a*), and four accessing periods ACCESS set by generator 30 during the 16-clock period are used as writing period WRITE in memory 10.

Figures 7, 8:
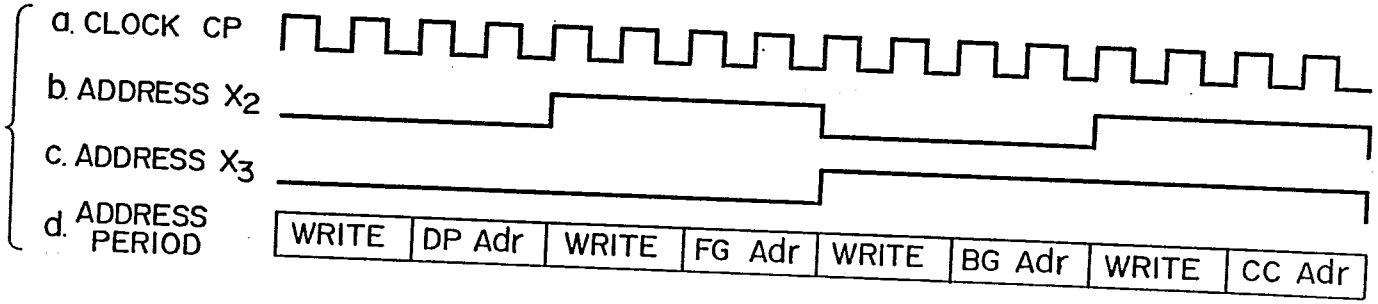
FIGS. 7 and 8 are timing charts showing the relationship between the clocks and the addressing period in the mode I of the embodiment shown in FIG. 3 and a diagram showing the relationship between the addressing period and the address signal.

The outputs of registers 24 and 25 are supplied through address switch 50 as the address (FIG. 8) to memory 10 during writing period WRITE at the timing shown in FIG. 7. FIG. 8 shows the addressing period and the content of the address. The address corresponding to the image data of FIG. 7(*d*) is supplied from counters 21 and 22 to memory 10 as shown in FIG. 8. Here, the address area for dot pattern DP and color data (i.e., FG color data, BG color data and data attribute CC) is divided by the address $A_{12}$ of the more significant bits of memory 10. Further, addresses $A_{10}$ and $A_{11}$ (i.e., the outputs $X_2$, $X_3$ of counter 21 shown in FIGS. 7(*b*) and 7(*c*)) define the area for storing FG color data, BG color data and data attribute CC.

In mode I, a cycle steal is executed to allow the CPU to gain access to memory 10 even during the displaying period, thereby enhancing the writing efficiency of the image data.

Figures 9, 10:
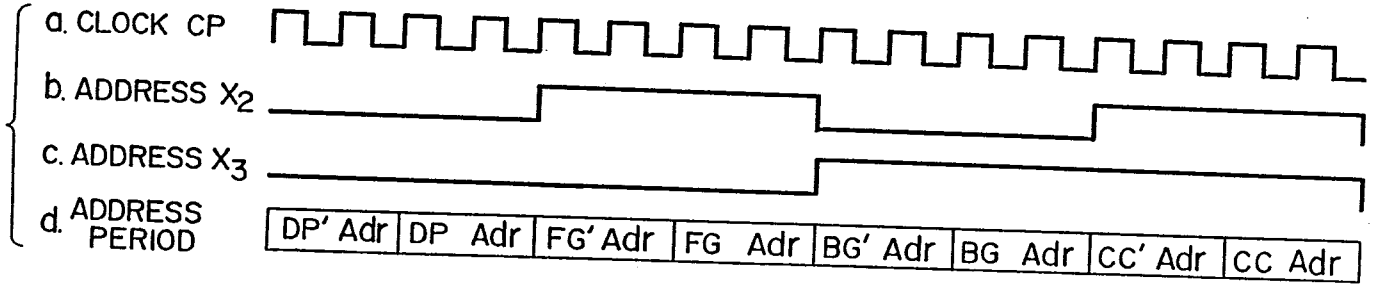
FIGS. 9 and 10 are timing charts showing the relationship between the clocks and the addressing period in the mode II of the embodiment shown in FIG. 3 and a diagram showing the relationship between the addressing period and the address signal.

In mode II, the image data for two pictures is stored in memory 10 as shown in FIG. 5(*b*), and the address for other display data is output during four accessing periods ACCESS. The outputs of counters 21, 23 are supplied as the address (FIG. 10) from switch 50 to memory 10 during period DP' Adr as shown in FIG. 9. FIG. 10 shows the address and the control of the address. The addressing period, i.e., DP Adr, is the same as in mode I.

The area for storing the image data for two pictures is divided by most significant bit $A_{13}$ of memory 10. In mode II, the addresses of the data showing the two pictures is supplied. That is, mode II is the hybrid display mode described above. Since the vertical address is generated by two counters 22 and 23, the two pictures can be scrolled independently.

As evident from FIG. 9(*d*), the writing of the image data in memory 10 by the CPU is not executed during the display period, it can be performed only during the nondisplaying period in mode II.

In mode III, four accessing periods ACCESS are used during the writing period in the same manner as in mode I. In order to execute the coloring of a dot unit, four dot patterns are stored in memory 10 as shown in FIG. 5(*c*). In FIG. 5(*c*), 8 colors and 2 halftones, for a total of 16 fine colors of one picture element unit, are executed, for example, in response to the R surface (red information) on the dot pattern $DP_1$, G surface (green information) on the dot pattern $DP_2$, B surface (blue information) on the dot pattern $DP_2$ and I surface (brightness information).

Figures 11, 12:
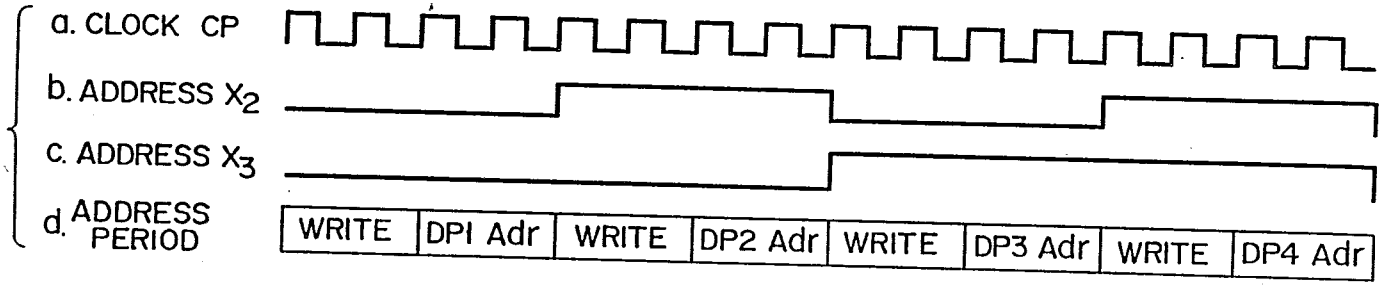
FIGS. 11 and 12 are timing charts showing the relationship between the clocks and the addressing period in the mode III of the embodiment shown in FIG. 3 and a diagram showing the relationship between the addressing period and the address signal.

Therefore, the outputs of counters 21 and 22 are supplied to memory 10 during the addressing periods as shown in FIG. 11, and the contents of the output address are as shown in FIG. 12. The area of storing the dot patterns $DP_1$ to $DP_4$ is divided by addresses $A_{12}$ and $A_{13}$ (i.e., outputs $X_2$, $X_3$ of the counters 21), shown in FIGS. 11(*b*) and 11(*c*). The supply of the address during writing period WRITE is similar to that in mode I. The writing in memory 10 is also executed even during the displaying period in the same manner as that in mode I.

In the embodiments described above, the data bus MD of memory 10 is formed of 16 bits, four accessing periods ACCESS are provided during 16 clock periods, and the address supplied from generator 20 in response to the three different modes stored in register 19 is selected by switch 50. Therefore, various addressings can be performed for memory 10, and efficient addressing control can be executed in response to the modes.

In the embodiments described above, the display control system can be integrated by N-MOS or C-MOS technique into one LSI. Thus, the system can correspond to a cycle steal mode, a hybrid mode, or a dot unit coloring mode in response to the selection of the addressing mode.

According to the present invention, since an address space of a memory image is divided into a plurality of sub-spaces to which a plurality of kinds of image data constituting one picture image is stored, and the data is read out in a time division basis, the width of the data bus does not increase, even if the number of kinds of stored data increases.

The present invention is not limited to the particular embodiments described above. The present invention can be arbitrarily set in the constitution of the data bus and the types of the addressing modes. Further, the present invention can be applied not only to the receiver terminal of the teletext system but also to various displaying units.

What is claimed is:

1. A method of controlling image data to be displayed by a raster scanning display unit, comprising the steps of:

storing pieces of image data representing at least one picture at addresses of an image memory which corresponds to an image display area;

generating a plurality of address signals designating said addresses in synchronism with said raster scanning performed in said display unit;

defining a timing of access to said image memory by dividing into sub-periods a predetermined display period by using said generated address signal;

setting one of various data storage modes for representing a memory arrangement of image data in which image data can be stored in said image memory wherein each mode corresponds to a different type of display;

selecting one of said address signals in accordance with the mode set in said mode setting step and said access timing defined in said access timing defining step; and supplying said selected address signal to said image memory.

2. A display control system for controlling image data to be displayed on a raster scanning display unit, comprising:

an image memory for storing pieces of image data representing at least one picture, said image memory including an address space capable of storing kinds of image data of at least one picture, respective kinds of said image data being stored at addresses of sub-spaces, said sub-spaces being obtained by dividing said address space corresponding to an image display area, the number of bits at respective addresses being equal to a bit width of a data bus connected to said image memory;

address generating means, coupled to said image memory, for generating a plurality of address signals designating said addresses of said image memory in synchronism with a raster scanning performed in said raster scanning display unit;

timing control means, coupled to said address generating means, for defining a timing of access to said image memory by dividing a predetermined period in accordance with said address signals generated by said address generating means, said timing control means operating as a time division control unit for dividing into sub-periods a display period necessary to fully display image data read out from said image memory;

mode setting means for setting a data storage mode representing a memory arrangement of image data stored in said image memory, wherein each mode corresponds to a different type of display;

address selecting means, responsive to said address generating means and said mode setting means, for selecting one of said address signals in accordance with said data storage mode set by said mode setting means and said access timing defined by said timing control means and supplying said selected address signal to said image memory; and data decoding means, coupled to said image memory, for decoding data read out from an address of said image memory designated by said address selecting means, wherein said data bus is connected between said data decoding means and said image memory and has a width corresponding to a number of input bits of data supplied to said data decoding means.

3. The display control system according to claim 2, wherein said pieces of image data stored in said image memory are brightness data representing the brightness of one picture element and color data representing the color of a block consisting of a plurality of picture elements.

4. The display control system according to claim 2, wherein each of said pieces of image data stored in said image memory consists of pieces of color data representing the color of a picture element.

5. The display control system according to claim 2, wherein said address generating means generates display address signals in synchronism with said raster scanning performed by said display unit, and said address signals are used to provide access to said image memory for reading data for purposes other than to display the image data by accessing said image memory during the period other than said display period.

6. The display control system according to claim 2, wherein said address generating means generates display address signals of two picture images synchronous with the raster scanning performed by said display unit to cause a displaying of a hybrid picture on said display unit.

7. The display control system according to claim 2, wherein said image memory has an address space capable of storing data of at least two image pictures.

* * * * *